US005726427A

United States Patent [19]

Hwang

[11] Patent Number: 5,726,427

[45] Date of Patent: Mar. 10, 1998

[54] IMPROVED HINGE MOUNTING FOR A MICROWAVE OVEN DOOR

[75] Inventor: Yun Ic Hwang, Suwon, Rep. of Korea

[73] Assignee: Samsung Electronics Co., LTD., Suwon, Rep. of Korea

[21] Appl. No.: 722,846

[22] Filed: Sep. 26, 1996

[30] Foreign Application Priority Data

Aug. 6, 1996 [KR] Rep. of Korea ..... 96-32771

[51] Int. Cl.[6] ..... H05B 6/76

[52] U.S. Cl. ..... 219/739; 219/756; 219/391; 126/194; 16/223

[58] Field of Search ..... 219/739, 756, 219/391, 404; 126/194; 16/223

[56] References Cited

U.S. PATENT DOCUMENTS

| | | | |
|---|---|---|---|
| 2,805,661 | 9/1957 | Pollock | 126/194 |
| 4,189,632 | 2/1980 | Swanson et al. | 219/413 |
| 4,255,640 | 3/1981 | Bressler | 219/739 |
| 5,158,503 | 10/1992 | Mitchell | 16/278 |

*Primary Examiner*—Philip H. Leung
*Attorney, Agent, or Firm*—Burns, Doane, Swecker & Mathis, L.L.P.

[57] ABSTRACT

A microwave oven includes a main body forming a cooking chamber, and a door hinged to the main body for opening and closing the cooking chamber. The main body includes upper and lower horizontal walls forming a top and bottom, respectively, of the cooking chamber. The door is mounted by two hinges, each hinge comprising a pivot pin carried by the door, and a hinge plate carried by the main body. Each hinge plate includes a door-connecting section and a body-connecting section interconnected by an intermediate section. All three of those sections are integrally formed on a one-piece element. The door-connecting section is at a higher elevation than the body-mounting section and includes a hole rotatably receiving the pivot pin. The body connecting section is directly connected to a respective one of the upper and lower horizontal walls. The door carries a stop element which abuts a vertical edge of a respective hinge plate when the door is in an open state.

4 Claims, 5 Drawing Sheets

IMPROVED HINGE MOUNTING FOR A MICROWAVE OVEN DOOR

FIELD OF THE INVENTION

The present invention relates to a microwave oven, and in particular to a door mounting of the microwave oven.

BACKGROUND OF THE INVENTION

FIG. 4 is an exploded-perspective view of a microwave oven with a conventional door.

As shown in FIG. 4, the conventional microwave oven includes a main body 10 which forms a cooking chamber 11 for providing a space for cooking foodstuffs and includes an electric component compartment 15 for accommodating various electrical components, a door 50 attached to the front side of the main body 10 so as to open and close the front opening 12, and an upper case 90 for protectively covering the interal components.

The cooking chamber 11 includes a front wall 25 with the front opening 12, a rear wall 27, upper and lower walls 21 and 23, and side walls 29R and 29L. Hinges 31 are inserted through a slot 26 of the front wall 25 and are attached to the door 50. For example, the upper hinge 31 is fastened to the upper-front corner of the upper wall 21 and the side wall 29L by the use of a fastening member (not illustrated), that allows the door 50 to pivot to the left of the main body 10.

The door 50 consists of outer and inner door panels 51 and 55. A glass plate 53 is interposed between the outer and inner panels 51 and 55 so as to let a user see the cooking procedures of foodstuffs and their conditions inside of the cooking chamber 11. A hinge pivot 57 is inserted into a pivot hole 37 of each hinge 31 to pivot the door 50 thereon and a projection 58 serving as a stopper of the door 50 is provided on one end of the inner door panel 55 adjacent to the hinge 31.

On each front of the hinge 31 are provided the pivot hole 37 into which a pivot 57 of the door 50 is inserted for free rotation, and a protrusion 32 downwardly-protruding from a lower face of the hinge 31 in order to limit the rotation of the door 50. The downwardly-protruding protrusion 32 is designed to contact the projection 58 of the inner door 55 when the door 50 is opened.

In such a microwave oven, a bracket 33 is spot-welded to the upper wall 21 of the main body 10, and this bracket 33 and the hinge 31 are joined together by the use of screws (not illustrated), which complicates the assembling processes of a microwave oven.

The projection 58 of the inner door 55 comes into contact with the downwardly-protruding protrusion 32 of the hinge 31 as the door 50 is opened, and the frequent use of the door 50 easily wears out the projection 58 or the downwardly-protruding protrusion 32 so that the door 50 may not be stopped at a correct position.

The spot-welding technique which is employed to join the thin-plate bracket 33 and the upper wall 21 of the main body 10 together, causes a deformation of the bracket 33, and it is difficult to achieve the proper mounting position of the hinge 31. When the door 50 is improperly joined to the main body 10 by the hinge 31 that is installed at an incorrect spot, a gap may be created between the door 50 and the main body 10 so that electromagnetic waves which are deleterious to the human body leak out through the gap.

To cook by using such a microwave oven, a user opens the door 50 of the microwave oven, and puts a foodstuff to be cooked in the cooking chamber 11 and then closes the door 50. Once the cooking is finished, the user opens the door 50 again and takes the finished dish out of the cooking chamber 11. Such frequent opening and closing operations of the door 50 are hard on its hinge member, and adversely affect the reliability of the microwave oven of this construction.

In other words, repeatedly opening and closing the door induces a deformation of the hinge member that holds the door. The deformation of the hinge member creates a gap between the door and the main body of the microwave oven, and is apt to cause a leakage of electromagnetic waves.

Moreover, when the downwardly-protruding protrusion 32 provided on the hinge becomes too abraded, the door cannot maintain the correct opening position, or the door may open too much by passing by the slightly worn-out protruding section, whereupon the protrusion may act as an obstacle to a subsequent closing of the door. Depending on the circumstances, a crooked protrusion can make the opening and closing of the door an impossible task.

SUMMARY OF THE INVENTION

Accordingly, the present invention encompasses a microwave oven with an improved door mounting that substantially obviates the problems due to limitations and disadvantages of the conventional art.

It is an object of the present invention to provide a microwave oven with a door mounting of improved construction in which a hinge member of the door and a hinge supporting bracket are formed in one united body so as to reduce the number of assembling steps.

It is another object of the present invention to provide a microwave oven having a door connected to a pair of integrally-formed one-piece hinge member that allow the door to be opened at a predetermined angle with respect to a main body of the microwave oven and to exactly maintain the opening position of the door thereby.

In order to achieve the above objects and advantages and in accordance with the purpose of the present invention, as embodied and broadly described, a microwave oven of the present invention includes a main body constituting a cooking chamber; a door having a pivot pin and an upwardly-projected rod adjacent to the pivot pin and serving to open and close a front opening of the main body; and a hinge member integrally formed to have a pivot hole into which the pivot pin is rotatably fitted, a stopper formed to transversely contact the rod, and a slit for accommodating a flank of the door when the door is opened to the maximum. The plate thickness (vertical edge) of the hinge member serves as a stopper.

BRIEF DESCRIPTION OF THE DRAWINGS

The above objects and other advantages of the present invention will become more apparent upon consideration of presently preferred embodiments of the present invention with reference to the attached drawings in which.

DESCRIPTION OF THE PREFERRED EMBODIMENT

Figure 1:
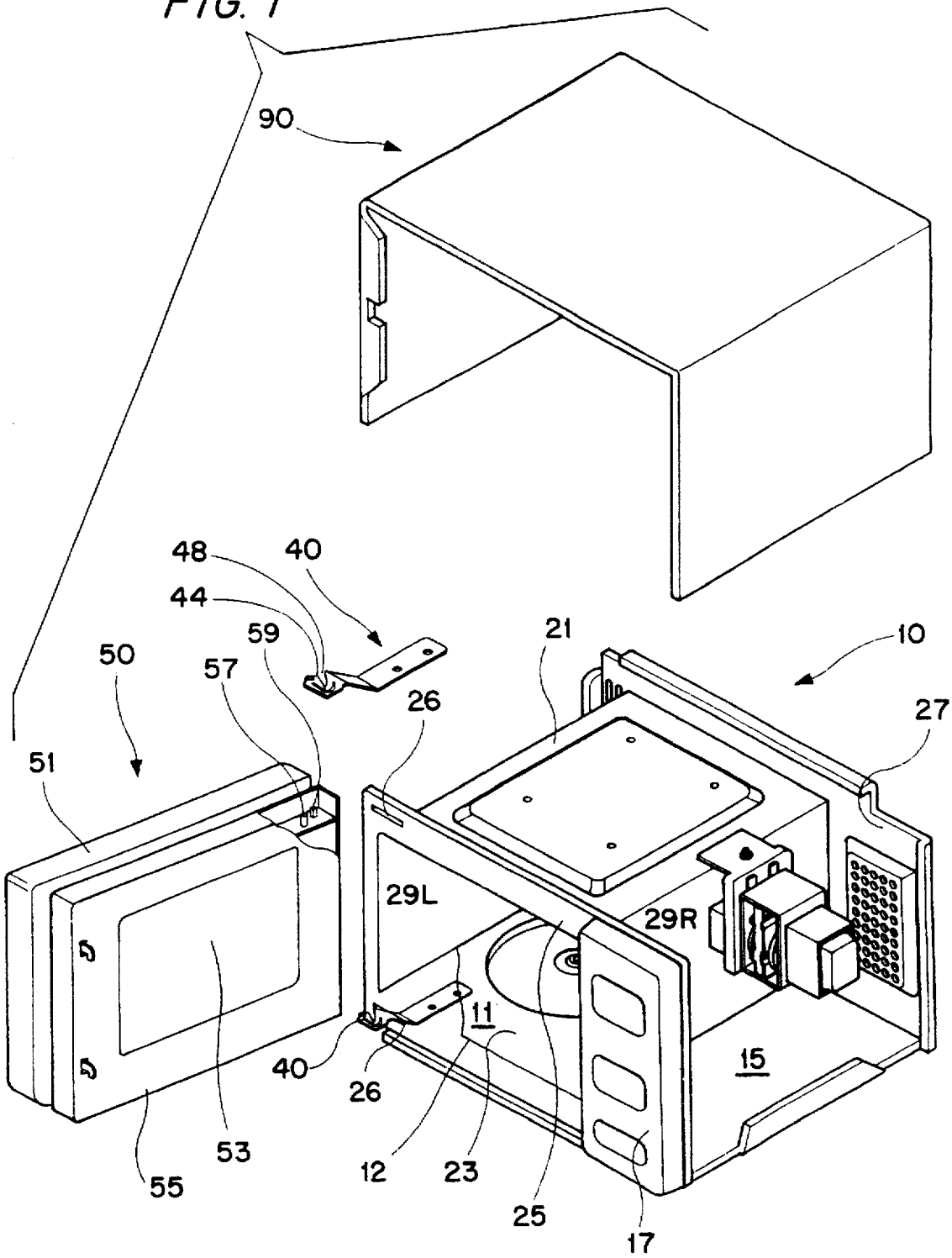
FIG. 1 is an exploded-perspective view of a microwave oven having a door mounting in accordance with the present invention.

A preferred embodiment of the present invention will now be discussed in detail with reference to the accompanying drawings. Throughout the drawings and the specification, similar reference numerals denote similar elements. Moreover, redundant descriptions of features common between the conventional art and preferred embodiment of the present invention are omitted.

Figure 2:
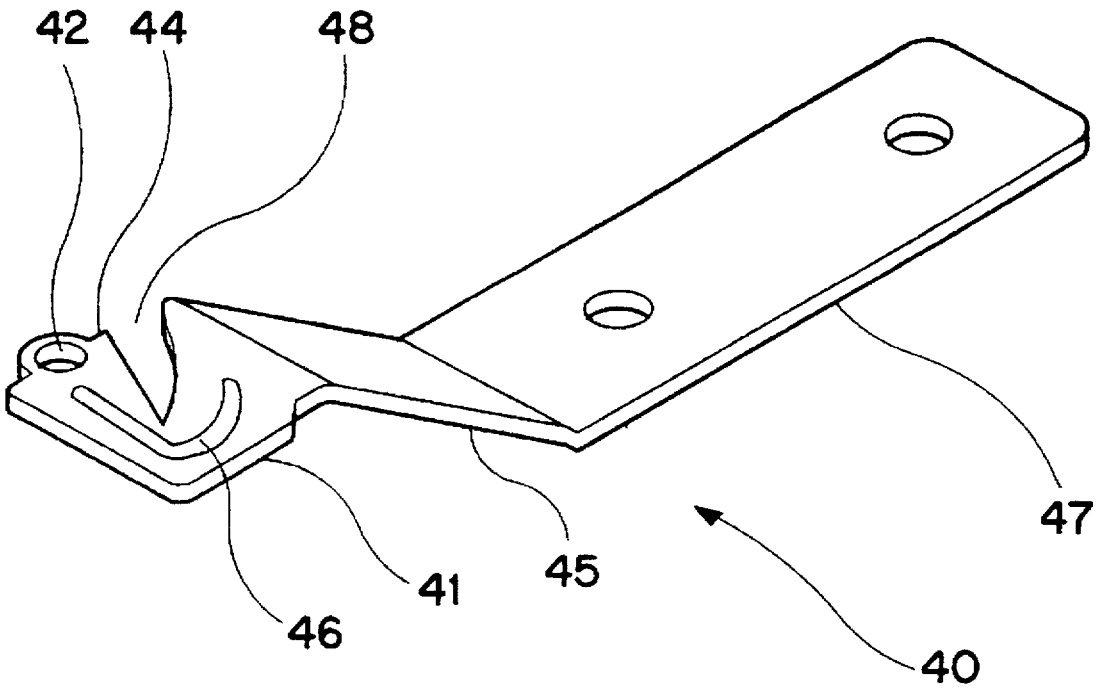
FIG. 2 is an enlarged-perspective view of a hinge member of the door in accordance with the present invention.

FIG. 1 depicts a microwave oven having a door being of improved construction in accordance with the present invention, and FIG. 2 is an enlarged-perspective view of a hinge member of the inventive door of the microwave oven.

A microwave oven includes a main body 10 which forms a cooking chamber 11 and, an electric component-compartment 15, and a door 50 is attached to the front side of the main body 10 so as to open and close a front opening 12 of the main body 10.

The microwave oven also includes an upper case 90 which protectively covers the upper and side portions of the main body 10. The cooking chamber 11 includes upper and lower walls 21 and 23, front and rear walls 25 and 27, and side walls 29R and 29L.

A door 50 of the microwave oven consists of an inner door panel 55, and an outer door panel 51 accommodating the inner door panel 55. The door also includes a pivot pin 57 that serves to allow the door 50 to turn thereon, and a rod 59 that sets limits to rotation of the door 50 and is disposed on one end of the inner door 55. Upper and lower hinge members 40 are fastened to the body 10. For example the upper hinge member 40 is fastened to the upper wall 21 of the main body 10 by the use of screws (not illustrated) and allows the door 50 to pivot to the left of the main body 10.

As shown in FIG. 2 which is an enlarged-perspective view of the inventive hinge member of the door, this upper hinge member 40 consists of a door-connecting section 41 joined to the door 50, a body-connecting section 47 joined directly to the upper wall 21 of the main body 10, and an inclined intermediate section 45 interposed between the door-connecting section 41 and body-connecting sections 47. An angle of inclination at which the inclined section 45 extends is selected to facilitate insertion of the hinge member 40 into a slot 26 provided on the front wall 25 of the main body 10.

In the meantime, the door-connecting section 41 of the hinge member 40 is designed to vertically spaced, preferably higher with respect to the body-connecting section 47 so that the door-connecting section 41 can be joined to the pivot pin of the door 50. The door-connecting section 41 has a pivot hole 42 into which the pivot pin 57 is inserted for free rotation, and a stopper 44 which abuts the rod 59. The stopper 44 is formed by a vertical edge of the door-connecting section 41. The door-connecting section 41 also includes a slit 48 that can accommodate a vertical flange or flank 60 of the door 50 that will be discussed later to facilitate the movement of the door 50, and an embossed elongated portion 46 for reinforcing the door-connecting section 41.

The body-connecting section 47 of the upper hinge member 40 is pushed through the slot 26 of the front wall 25 and this body-connecting section 47 is then fixed onto the upper wall 21 of the main body 10 by the use of screws (not illustrated). Subsequently, the pivot pin 57 of the door 50 is rotatably fitted into the pivot hole 42 of the door-connecting section 41 sticking out from the slot 26 toward the door 50.

Once a push button provided on the control panel 17 is pressed while the door 50, rotatably joined to the main body 10 by the integral hinge member 40, has closed the front opening 12 of the main body 10, the door 50 pivots on the main body 10 and swings open about the pivot pin 57.

After foodstuffs to be cooked are put on a tray in the cooking chamber 11, the front opening 12 of the cooking chamber 11 is closed by the door 50, and the cooking is then carried out. Once the cooking is finished, the door 50 is opened in the above-mentioned manner, and the finished dish is taken out from the cooking chamber 11 and the door 50 is closed again.

Figure 3A:
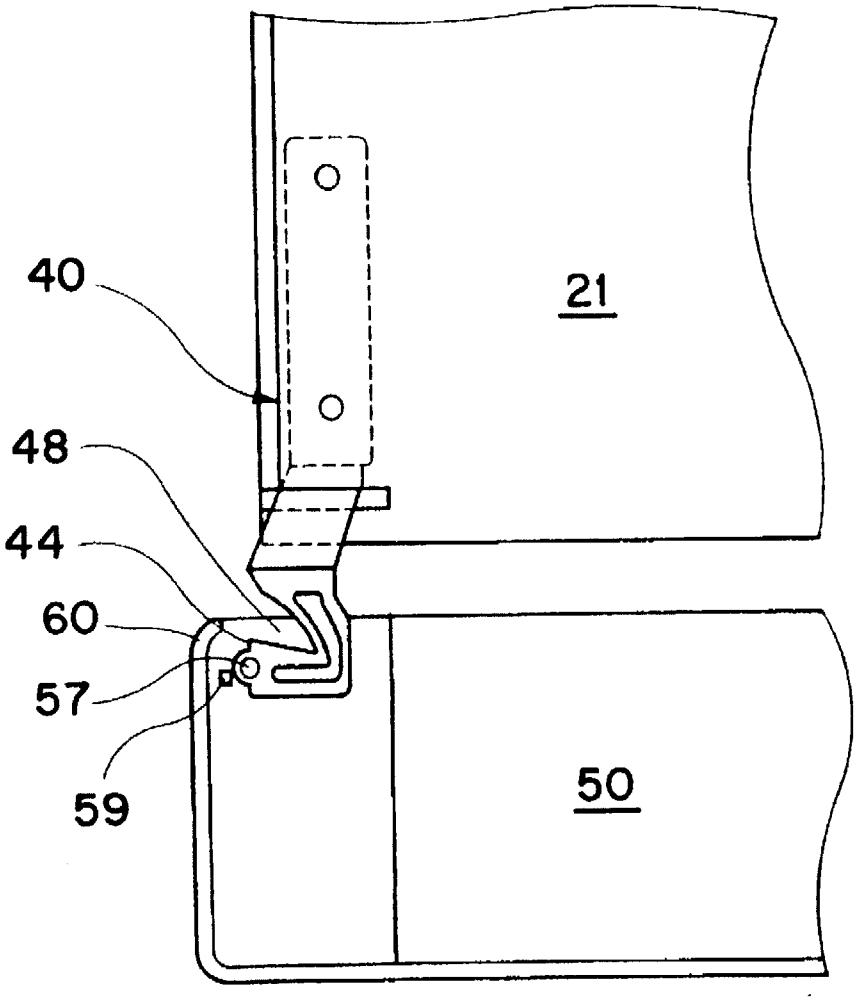
FIGS. 3A and 3B respectively illustrate closed and opened conditions of the door in accordance with the present invention.
Figure 3B:
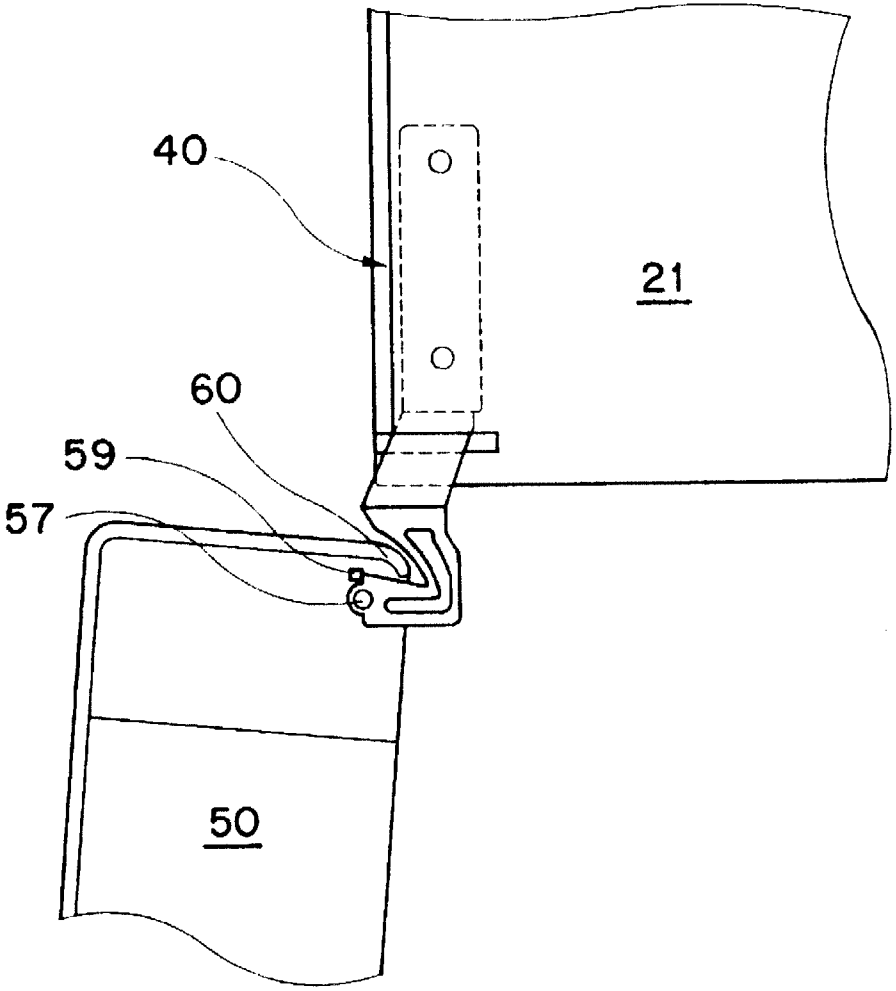
Figure 4:
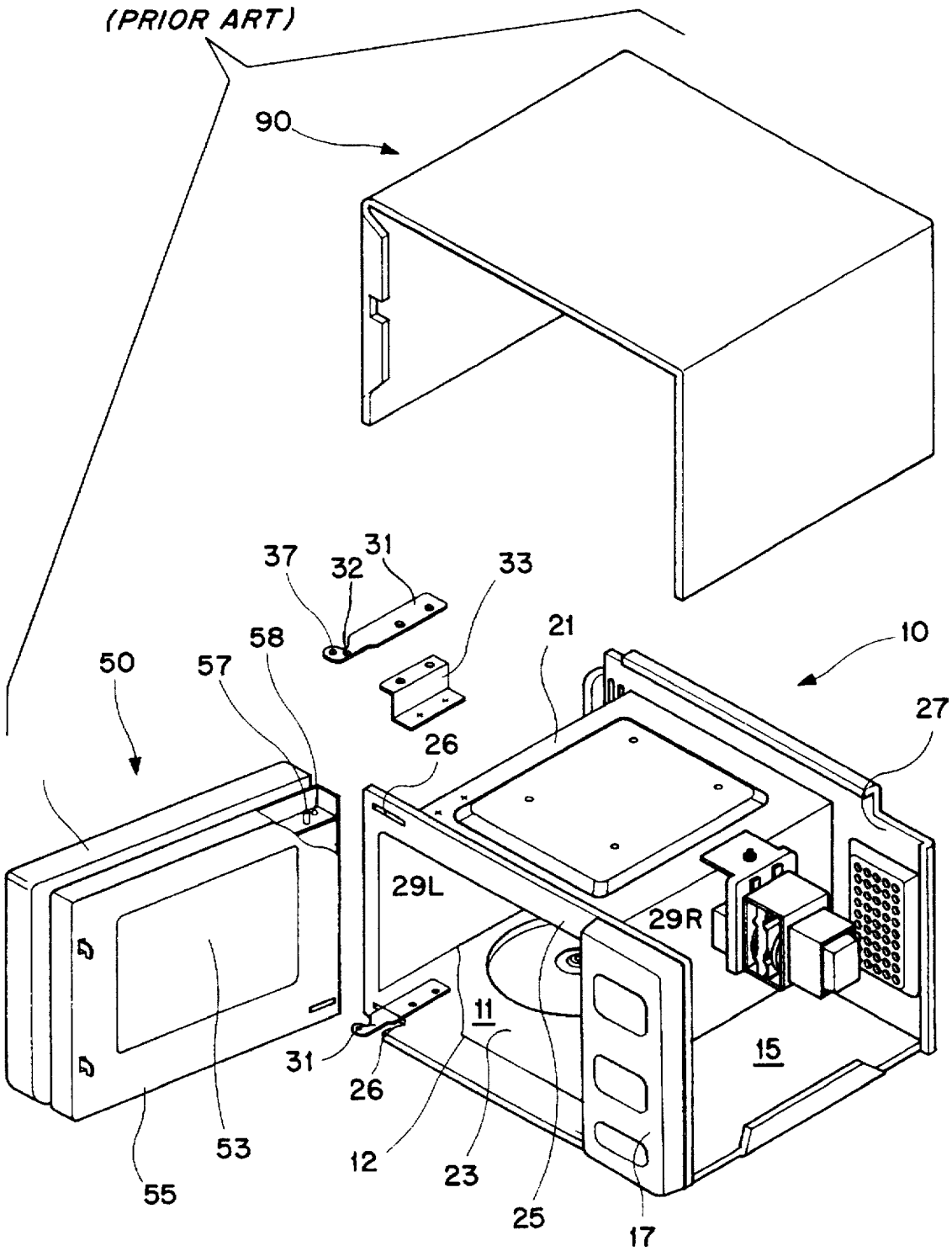
FIG. 4 (PRIOR ART)
FIG. 4 is an exploded-perspective view of a microwave oven with a conventional door mounting.

FIGS. 3A and 3B respectively depict the opened and closed states of the door 50.

As depicted in FIG. 3A, when the door 50 is being closed, the rod 59, that is formed to upwardly protrude from the upper part of the door 50, moves away from the stopper 44 of the hinge member 40, joined to the upper wall 21 of the main body 10, and the flank 60 of the door 50 slips out of the slit 48 of the hinge member 40.

When a user presses the push button of the control panel 17 to open the door 50, the door 50 pivots to the outside on the pivot pin 57 that is supported by the hinge member 40. As shown in FIG. 3B, if the door 50 is opened to the maximum, the slit 48 of the hinge member 40 accommodates the flank 60 of the door 50 to thereby prevent the flank 60 from hindering the rotation of the door 50.

The rod 59 of the door 50 comes into contact with the stopper 44 of the hinge member 40 in such a manner that the door 50 is not opened any further and the door 50 and the hinge member 40 are free from deformation.

According to the present invention, the hinge member of the door is designed to be of one piece and can be easily and promptly joined to the main body of the microwave oven whereby the number of the assembly steps can be decreased. Further, the rotation supporting member that serves to maintain the opening position of the door is provided to the door and the hinge member so that the reliability to the door of the microwave oven can be enhanced.

Still further, the hinge member of the present invention which supports the door of the microwave oven is attached directly to the upper wall of the main body, and such a construction prevents deformation of the hinge member and creation of a gap between the door and the main body of the microwave oven, which ensures an enhanced reliability of microwave ovens of being such a construction.

The preferred embodiment of the present invention are given by way of example, and the invention recited in the attached claims is not limited to the illustrative embodiment. Those of ordinary skill in the art will recognize that routine design changes may be made to the exemplary embodiment without departing from the scope of the claims.

What is claimed is:

1. A microwave oven comprising:

a main body forming a cooking chamber with an access opening;

a door hinged to the main body for opening and closing the access opening, the door being hinged to the main body by upper and lower hinges; each of the hinges comprising a vertical pivot pin mounted on the door, and a hinge member mounted on the body; the hinge member including a body-connecting section, a door-connecting section, and an intermediate section interconnecting the body-connecting and door-connecting sections; the body-connecting, door-connecting, and intermediate sections being integrally formed as a one-piece element; the door-connecting section including a hole rotatably receiving the pivot pin; the body-connecting section being directly connected to the main body, and the door-connecting section disposed higher than the body-connecting section; the door-connecting section including a vertical edge; the door including at least one stop element arranged to abut the vertical edge of a respective door-connecting section; the door including upper and lower vertical flanges; the door connecting section including a slit projecting from the vertical edge for accommodating a respective flange when the door is an open state; the door-connecting section including an embossed elongated ridge spaced from the vertical edge for reinforcing the door-connecting section.

2. The microwave oven according to claim 1 wherein the main body includes lower and upper horizontal walls forming a bottom and top, respectively, of the cooking chamber; the body-connecting portion of the upper hinge being directly connected to the upper wall, and the body-connecting portion of the lower hinge being directly connected to the lower wall.

3. The microwave oven according to claim 1 wherein the door includes two stop elements arranged to abut the vertical edges of respective door-connecting sections.

4. The microwave oven according to claim 1 wherein the door is mounted at a front side of the main body; the cooking chamber extending rearwardly from the door; the stop element on the door positioned in a first location when the door is closed, and in a second location when engaging the vertical edge; the second location situated rearwardly of the first location.

* * * * *